US009144911B2

(12) United States Patent
Arndt et al.

(10) Patent No.: US 9,144,911 B2
(45) Date of Patent: Sep. 29, 2015

(54) LINEAR DRIVE SYSTEM FOR HAIR CLIPPERS

(71) Applicants: Steven Arndt, Geneseo, IL (US); Gary Snow, Rock Falls, IL (US); Jeff Gesiakowski, Sterling, IL (US); Robert Buck, Jr., Rock Falls, IL (US)

(72) Inventors: Steven Arndt, Geneseo, IL (US); Gary Snow, Rock Falls, IL (US); Jeff Gesiakowski, Sterling, IL (US); Robert Buck, Jr., Rock Falls, IL (US)

(73) Assignee: Wahl Clipper Corporation, Sterling, IL (US)

( * ) Notice: Subject to any disclaimer, the term of this patent is extended or adjusted under 35 U.S.C. 154(b) by 301 days.

(21) Appl. No.: 13/906,605

(22) Filed: May 31, 2013

(65) Prior Publication Data

US 2014/0352159 A1 Dec. 4, 2014

(51) Int. Cl.
*B26B 19/06* (2006.01)
*B26B 19/28* (2006.01)

(52) U.S. Cl.
CPC ..... *B26B 19/06* (2013.01); *B26B 19/28* (2013.01)

(58) Field of Classification Search
CPC ..... B26B 19/06; B26B 19/28
See application file for complete search history.

(56) References Cited

U.S. PATENT DOCUMENTS 3,430,342 A 3/1969 Wahl
3,458,932 A 8/1969 Fox
3,561,116 A 2/1971 Wahl
3,589,007 A 6/1971 Walton
4,985,999 A * 1/1991 Iwasaki et al. ..... 30/206
5,068,966 A * 12/1991 Wahl et al. ..... 30/43.2
5,230,153 A * 7/1993 Andis ..... 30/216
2002/0170180 A1 11/2002 Brill

FOREIGN PATENT DOCUMENTS

DE 21 17 319 A1 10/1972
EP 2 808 135 A1 * 12/2014

OTHER PUBLICATIONS

Wahl GMBH hair trimmer with pivot motor; introduced in 2011.
Wahl Beret/Mag hair trimmers; introduced in 2002.
Wahl rotary motor hair clipper blade set; introduced in 1990s.
Wahl hair clipper introduced in 1969.
Wahl Chrome Pro Clipper; introduced in Jan.-Mar. 2013.
EP Search Report issued in EP App. No. 14 17 0570 , dated Oct. 22, 2014.
Wahl Groomsman trimmers; introduced in1980s.
Wahl hair clippers blade set introduced in 2009.

* cited by examiner

*Primary Examiner* — Hwei C Payer
(74) *Attorney, Agent, or Firm* — Greer Burns & Crain Ltd.

(57) ABSTRACT

A hair clipper has a base housing, a secondary housing cover, and a rotary motor or vibrator motor secured between the base housing and the housing cover. The rotary motor has a shaft and a cam secured to an end of the shaft, and the vibrator motor has a drive arm with a drive finger. A cam follower is operably connected to the cam or drive finger on a top side. The top side of the cam follower also has an elongated guide rail that is operably secured to a guide channel in a blade guide, which in turn is secured to the base housing. A reciprocating blade is operably secured to the bottom side of the cam follower, and a stationary blade is secured to the base housing adjacent the reciprocating blade.

8 Claims, 8 Drawing Sheets

LINEAR DRIVE SYSTEM FOR HAIR CLIPPERS

This invention relates to hair clippers, and more particularly to drive systems for hair clippers driven by a rotary motor or a vibrator motor.

BACKGROUND OF THE INVENTION

Hair clippers require drive systems that maintain linear motion of a reciprocating blade. To guide the reciprocating blade parallel to the stationary blade, the drive systems require precision tolerances. They may use a spring to guide the reciprocating blade in a near-linear path, but spring tolerances are difficult to sustain in manufacturing. As a result, the spring often requires adjustment at the factory assembly line to properly align the reciprocating blade with respect to the stationary blade.

Some drive systems have a guide channel formed in a thick section of the stationary blade, but the thick section is distanced from the cutting load, making the reciprocating blade guiding susceptible to binding. Moreover, sometimes an external feature (such as a cam follower flange) reciprocates outside of the housing, which is an aesthetic disadvantage, or a guide is molded on a housing that if excessively worn can require replacement of the entire housing and a more complex service repair procedure.

Another drive system design has a guide for guiding the reciprocating blade. The guide attaches to the perimeter of the clipper housings. Since a taper adjustment feature is provided on many hair clippers, this type of guide piece introduces more parts and additional manufacturing tolerances to sustain in production for the taper lever adjustment.

In addition, removal and re-assembly of the blade set can be awkward if the user in the field has to depress the spring and cam follower downward while inserting the reciprocating blade and fastening the fixed blade. Thus there is a need for improved drive systems for hair clippers.

Accordingly, one object of this invention is to provide new and improved hair clippers.

Another object is to provide new and improved drive systems for hair clippers driven by a rotary motor or a vibrator motor.

SUMMARY OF THE INVENTION

In keeping with one aspect of this invention, a hair clipper has a base housing and a secondary housing cover. A motor is secured between the base housing and the secondary housing cover. The motor can be a rotary motor having a shaft, a cam secured to an end of the shaft and a cam shaft, or a vibrator motor with a drive finger.

A cam follower is operably connected to the cam shaft or drive finger on one side of the cam follower. A blade guide is secured to the base housing, and the one side of the cam follower is operably secured to the blade guide.

A reciprocating blade is operably secured to the other side of the cam follower. A stationary blade is secured to the base housing adjacent the reciprocating blade.

BRIEF DESCRIPTION OF THE DRAWINGS

The above mentioned and other features of this invention and the manner of obtaining them will become more apparent, and the invention itself will be best understood by reference to the following description of an embodiment of the invention taken in conjunction with the accompanying drawings, in which.

DETAILED DESCRIPTION

Figure 1:
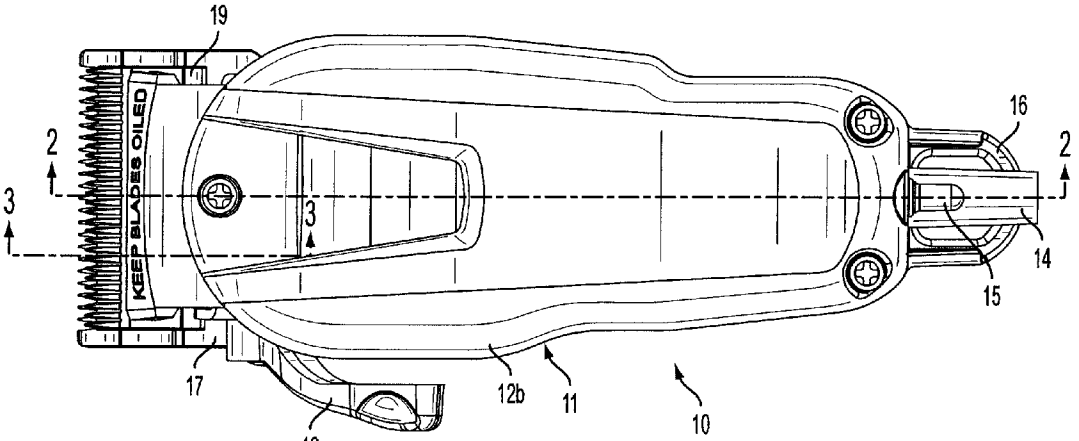
FIG. 1 is a top view of a hair clipper.
Figure 2:
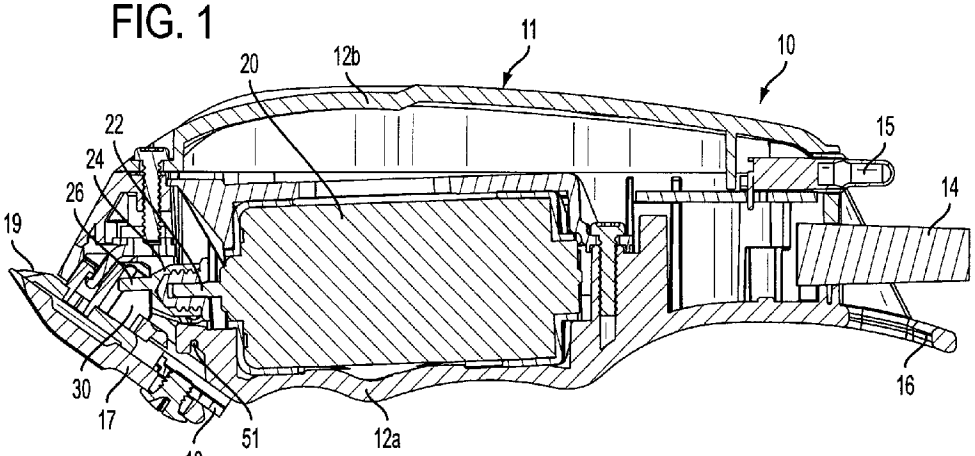
FIG. 2 is a cut-a-way view of the hair clipper of FIG. 1, taken along lines 2-2 in FIG. 1.

Referring to FIGS. 1 to 5, a hair clipper 10 (also known as a hair trimmer) has a housing 11. The housing 11 includes a base housing 12*a* and a secondary housing cover 12*b*. A taper adjustment lever 13, a power cord 14, a switch 15 and a hook hanger 16 are also provided.

A stationary blade 17 is secured to a taper adjustment bar 18, which in turn is slidably secured to the base housing 12*a*. The taper adjustment bar 18 and taper adjustment lever 13 are optional. The stationary blade 17 is operably secured to the base housing 12*a*, with or without blade adjustment.

Figure 4:
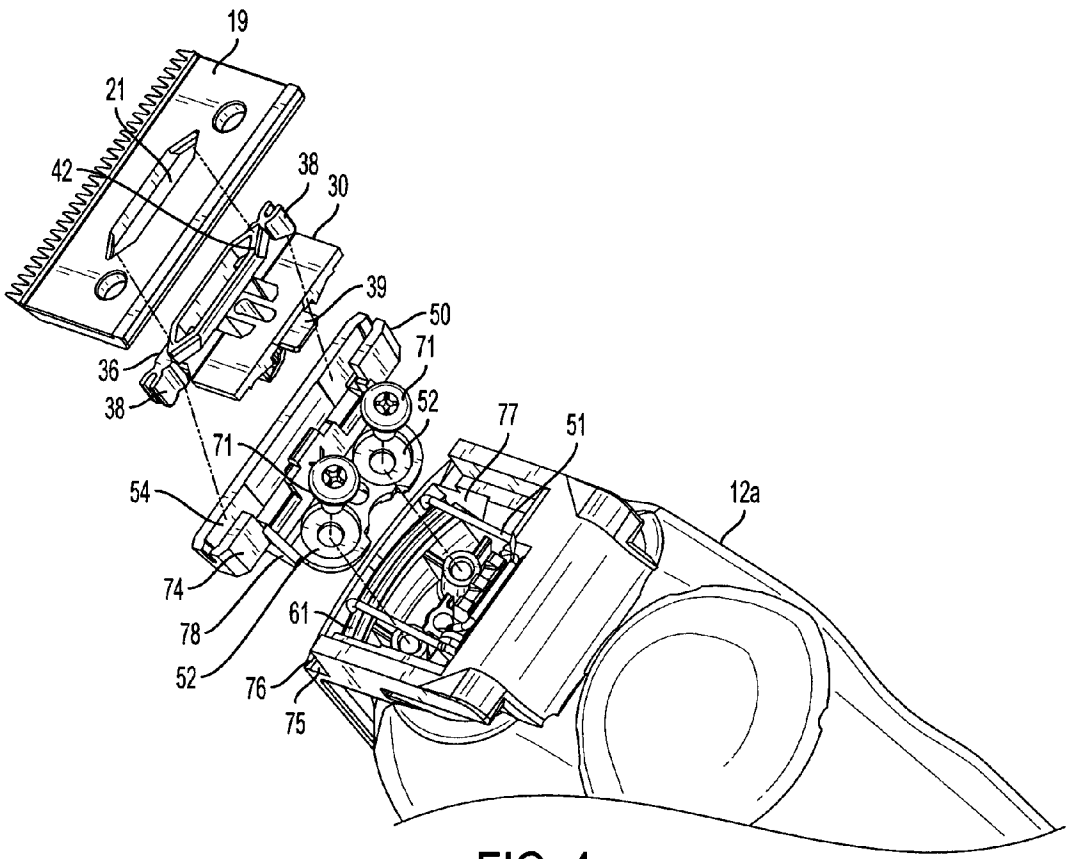
FIG. 4 is a partially exploded view of a portion of the hair clipper of FIG. 1.
Figure 3:
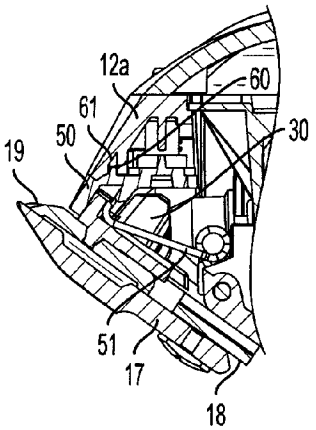
FIG. 3 is a partial cutaway view of the hair clipper of FIG. 1, taken along lines 3-3 in FIG. 1.
Figure 5:
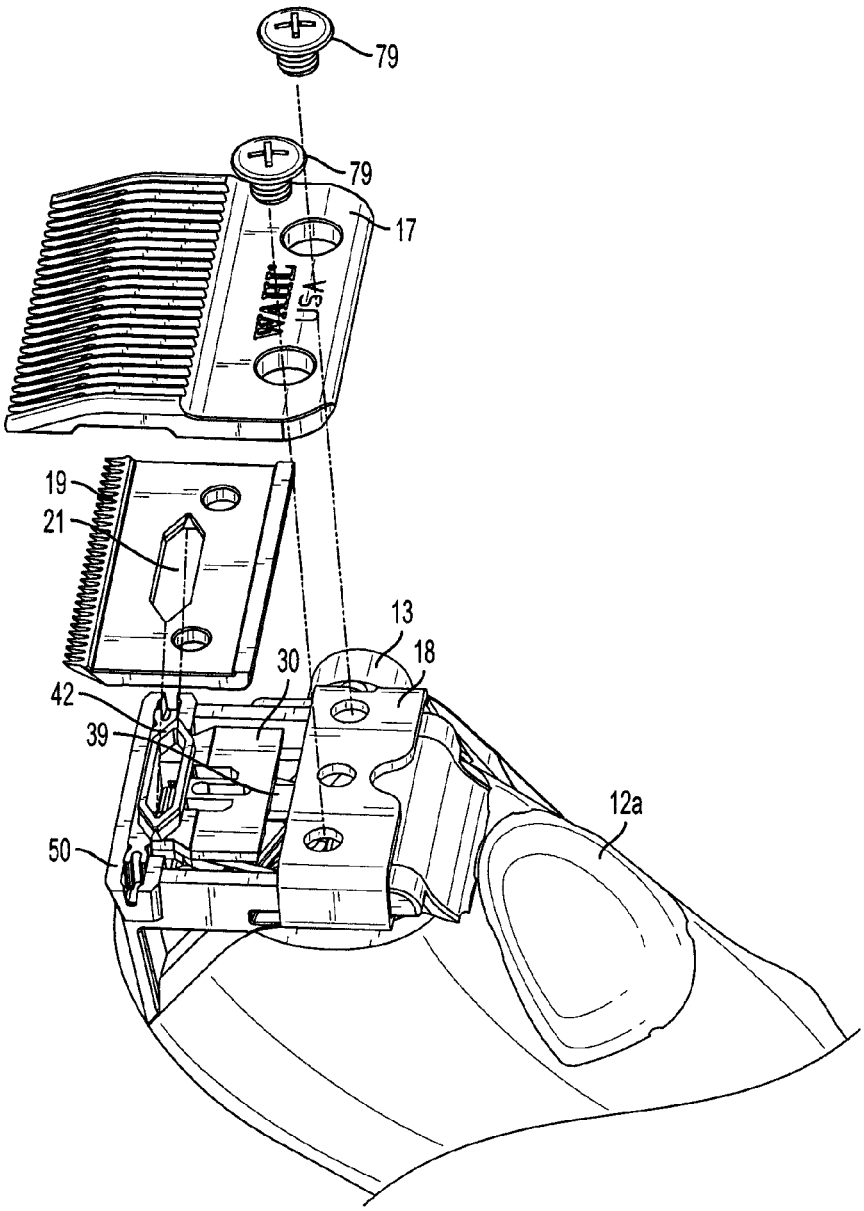
FIG. 5 is a partially exploded view of a portion of the hair clipper of FIG. 1.

A reciprocating blade 19 is operably secured adjacent the stationary blade 17. As seen in FIG. 4 and FIG. 5, the reciprocating blade 19 has an opening 21.

In this embodiment, a rotary motor 20 (FIG. 2) is secured between the base housing 12*a* and the secondary housing cover 12*b*. The motor 20 has a shaft 22 and a cam 24 secured to an end of the shaft 22.

Figure 6:
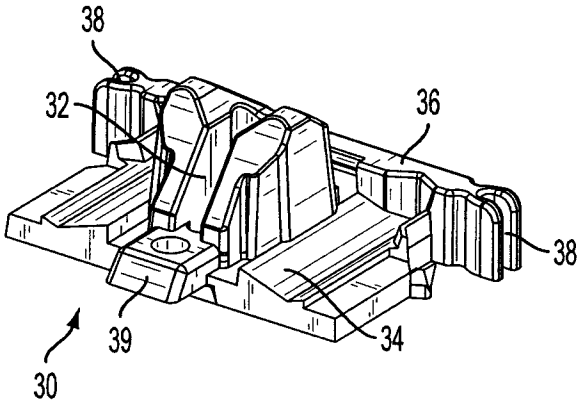
FIG. 6 is a perspective view of a cam follower used in the hair clipper of FIG. 1.

The cam 24 has an off-center (i.e., eccentric) cam shaft 26 that is operably engaged with a cam follower 30. The cam shaft 26 is a drive device that fits within a drive slot cavity 32 (FIG. 6) on a top side 34 of the cam follower 30. As the eccentric cam shaft 26 rotates, the cam follower 30 reciprocates back and forth in a linear manner.

An elongated guide rail 36 (FIG. 7) is provided at one end of the cam follower 30. The guide rail 36 includes U-shaped ends 38. A cam follower tab 39 is provided on the opposite end of the cam follower 30.

Figure 7:
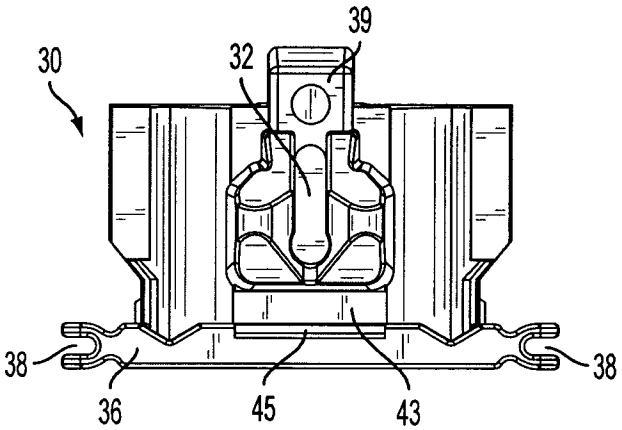
FIG. 7 is a plan view of a top side of the cam follower of FIG. 6.
Figure 8:
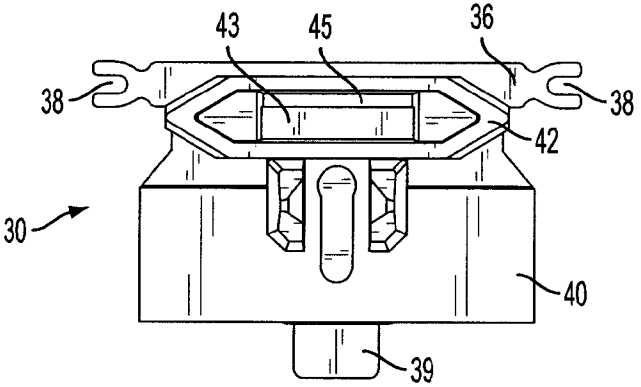
FIG. 8 is a plan view of a bottom side of the cam follower of FIG. 6.
Figure 10:
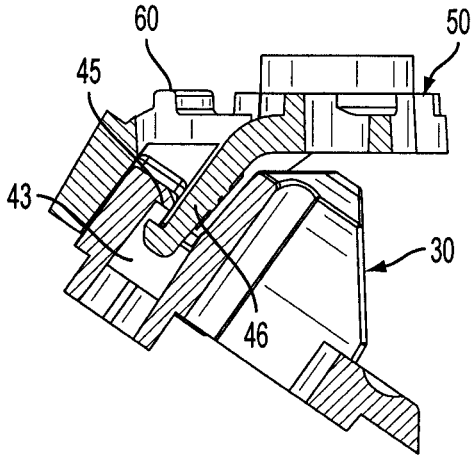
FIG. 10 is a cut-a-way view of the blade guide of FIG. 9, taken along lines 10-10 in FIG. 9, with the cam follower in FIG. 6 attached.
Figure 11:
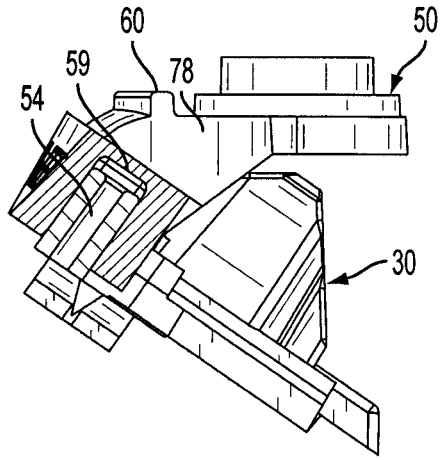
FIG. 11 is another cut-a-way view of the blade guide of FIG. 9, taken along lines 11-11 in FIG. 9, with the cam follower in FIG. 6 attached.

The cam follower 30 has a bottom side 40 (FIG. 8) that has a reciprocating blade engagement projection 42. An opening 43 and a cam follower hook 45 are provided for insertion of a blade guide snap 46 in a blade guide 50 (FIGS. 7, 8, 10).

A spring 51 (FIG. 3) presses the cam follower 30 and reciprocating blade 19 against the stationary blade 17. Force in the spring 51 tends to push the cam follower 30 out of the blade guide 50. The cam follower hook 45 and blade guide snap 46 (FIG. 10) compress the spring 51 and prevent the cam follower 30 from being removed or pushed out from the blade guide 50 when the stationary blade 17 is removed.

Figure 12:
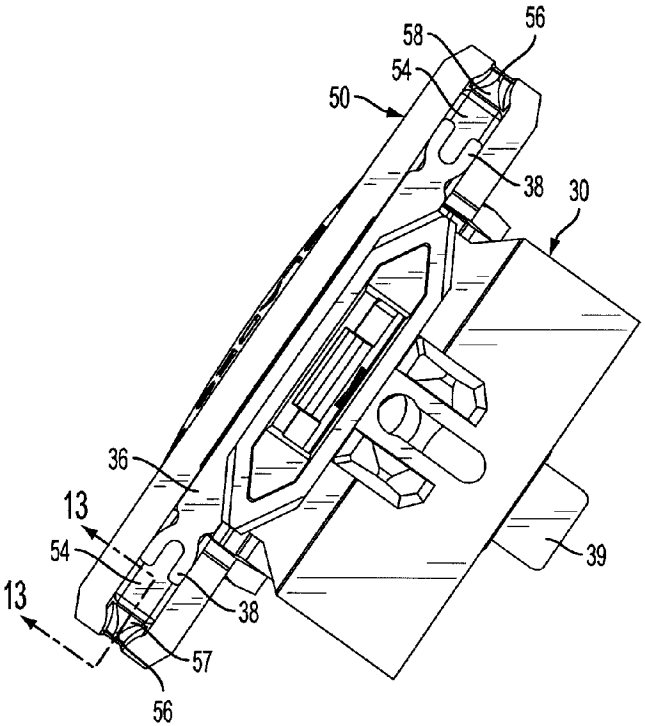
FIG. 12 is a plan view of a bottom side of the blade guide of FIG. 9 with the cam follower in FIG. 6 attached.

The blade guide 50 is secured inside of the base housing 12*a* with internal screws 71 (FIG. 4) that pass through openings in raised cylindrical bosses 52 (FIG. 4, 9). The blade guide 50 has an elongated guide channel 54 (FIG. 12) which accommodates and guides the guide rail 36 and U-shaped ends 38 of the cam follower 30.

The U-shaped ends 38 are preferably flexible so they can be slightly compressed in the guide channel 54, and allow a light interference fit with the blade guide. A light interference fit (lubricated as needed) is beneficial since it largely eliminates the possibility of clearance between the cam follower and the blade guide. Clearance between the guide parts can cause product noise, vibration and less parallel guiding if the reciprocating blade sways in motion.

The U-shaped ends 38 are also preferably equally biased on both sides to facilitate true parallel guiding of the reciprocating blade. Preferably, the ends of the U-shaped ends are spaced apart at the widest span possible between both U-shaped ends, for optimal linear motion of the reciprocating blade. The U-shaped ends 38 are also used for pushing most hair strands out of the blade guide 50, as will be seen.

Figure 14:
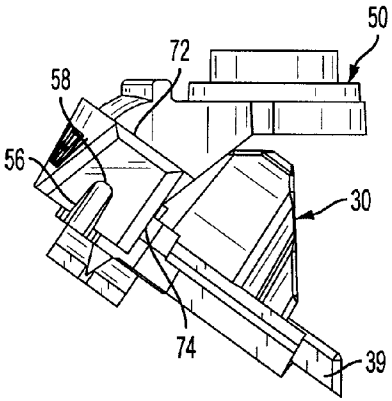
FIG. 14 is a plan view of a side of the blade guide of FIG. 9 with the cam follower in FIG. 6 attached.

Vents 56 (FIGS. 12, 14) are provided on each outer end of the guide channel 54, but the ends of the guide channel 54 are otherwise closed. In this manner, all reciprocating parts on the cam follower are substantially enclosed, so no reciprocating parts are external. The substantially closed ends improve the product appearance, and keep the internal workings cleaner.

Figure 13:
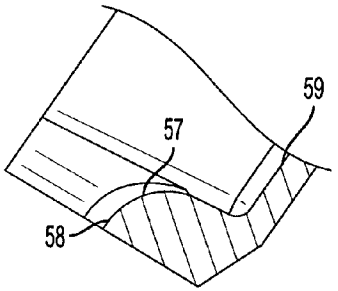
FIG. 13 is a sectional view taken along lines 13-13 in FIG. 12.

Chamfered surfaces 57 (FIG. 13) are blended between a bottom 58 of the vents 56 and a bottom 59 of the guide channel 54. Most cut hair strands are pushed out through the vents 56 by the U-shaped ends 38 of the cam follower 30.

Referring again to FIG. 3, the blade guide 50 has keying ribs that include one or more tongues 60 that fit in grooves 61 in the base housing 12*a* (FIG. 4).

Figure 9:
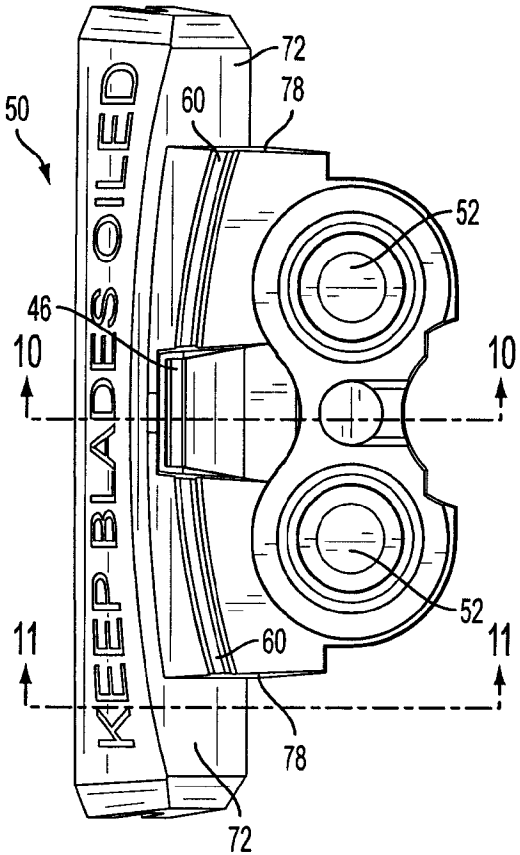
FIG. 9 is a top view of a blade guide used in the hair clipper of FIG. 1.

The hair clipper 10 is assembled by securing the blade guide 50 to the inside of the base housing 12*a* with fasteners 71 (FIG. 4). Edges 72, 74 (FIG. 14) of the blade guide 50 abut corresponding notched corners 75, 76 (FIG. 4) of the base housing 12*a*, to provide a wide support area for the blade guide. For additional stability, blade guide surface 78 (FIG. 9) contacts base housing surface 77 (FIG. 4). The cylindrical bosses 52 on the blade guide 50 are configured so that the blade guide 50 can be installed inside the base housing 12*a*.

The motor 20, with the cam 24 previously secured to the shaft 22, is mounted in the base housing 12*a* either before or after the blade guide 50 is secured. The cam follower 30 is installed by placing the cam follower tab 39 beneath the taper adjustment bar 18, to stabilize the cam follower 30 (FIG. 5). Then, the guide rail 36 is installed in the guide channel 54 (FIG. 12), such that the blade guide snap 46 passes through the opening 43 in the cam follower 30 and passes the hook 45 (FIG. 10). This snap and tab feature holds the spring in a compressed position which improves blade assembly. This is beneficial for factory assembly. It eliminates special assembly line fixtures and simplifies the assembly and installation of both the reciprocating and stationary blade to the clipper. This feature is also useful for the customers if the blades are removed from the clipper to be cleaned or replaced.

The reciprocating blade 19 is installed on the cam follower 30 by locating the opening 21 in the blade 19 over the projection 42 in the cam follower 30. A press fit of the projection 42 in the opening 21 holds the blade 19 in place. The stationary blade 17 is secured over the reciprocating blade 19 in alignment by fastening the stationary blade 17 to the taper adjustment bar 18 (FIG. 5) with fasteners 79.

In use, most of the cut hair strands fall away from the hair clipper 10, but some cut hair strands will presumably fall into the guide channel 54. However, most of those hair strands will be pushed out of the guide channel 54 through the vents 56 by the reciprocating action of the cam follower 30. The sloped surfaces 57 adjacent the vents 56 facilitate hair strand removal.

Figure 15:
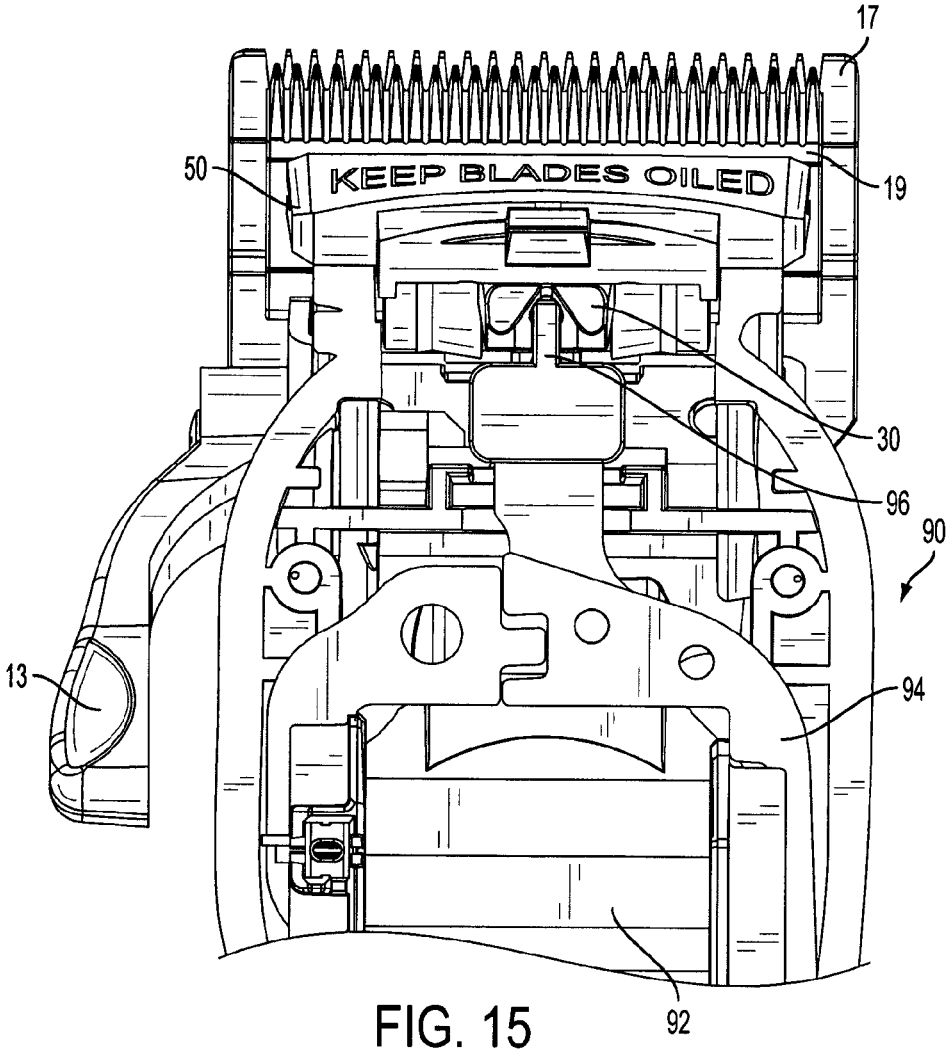
FIG. 15 is a partial inside view of a hair clipper having a vibrator motor with the blade guide and cam follower of FIGS. 1-14.

The cam follower 30 and blade guide 50 can have application in hair clippers having a vibrator motor, as seen in FIG. 15. A hair clipper 90 has a vibrator motor 92. The motor 92 has a drive arm 94 that reciprocates in an arcuate motion during operation. A drive finger 96 at one end of the drive arm 94 is another drive device that fits in the cavity in the cam follower 30.

The advantages of this invention are now apparent. The drive system uses parts that are better for sustaining precision manufacturing tolerances without assembly line adjustment. Blade alignment is improved since the guide rail and guide channel are closer to the cutting load and spaced wider to achieve optimum linear guiding. The drive system is enclosed, which is more aesthetically pleasing, and it is compact, and simpler to service or replace.

While the principles of the invention have been described above in connection with specific apparatus and applications, it is to be understood that this description is made only by way of example and not as a limitation on the scope of the invention.

What is claimed is:

1. A hair clipper comprising:

a housing, the housing comprising a base housing and a secondary housing cover, a motor secured between the base housing and the secondary housing cover, the motor having a drive device, a cam follower having a top side and a bottom side, the cam follower being operably connected to the drive device on the top side, a blade guide secured to the housing, the top side of the cam follower being operably secured to the blade guide, a spring, compression in the spring tending to push the cam follower out of the blade guide, a reciprocating blade operably secured to the bottom side of the cam follower, and a stationary blade operably secured to the housing adjacent the reciprocating blade, wherein the cam follower has a hook that attaches to a blade guide snap of the blade guide to compress the spring and prevent the cam follower from being removed from the blade guide when the stationary blade is removed, and the cam follower has a tab to engage under a taper adjustment bar slidably secured to the base housing to aid in cam follower retention when the stationary blade is removed.

2. The hair clipper of claim 1, wherein the blade guide has an elongated guide channel, and the cam follower has a corresponding elongated guide rail that operably fits inside of the elongated guide channel for reciprocal movement of the reciprocating blade.

3. The hair clipper of claim 2, wherein the blade guide has vents on side ends of the elongated guide channel, and chamfered surfaces extending from a bottom of the elongated guide channel to a bottom of the vents, the cam follower having U-shaped ends for pushing most of the cut hair strands out of the elongated guide channel through the blade guide vents.

4. The hair clipper of claim 2, wherein the cam follower has U-shaped ends that are flexible to allow compression and a light interference fit with the elongated guide channel.

5. The hair clipper of claim 4, wherein the U-shaped ends are equally biased while under compression.

6. The hair clipper of claim 1, wherein the motor is a rotary motor and the drive device is a cam shaft.

7. The hair clipper of claim 1, wherein the motor is a vibrator motor and the drive device is a drive finger.

8. The hair clipper of claim 1, wherein the blade guide is secured to the base housing with multiple locating features, including notched corners, two round bosses surrounding openings for fasteners, and tongue and groove keying ribs.

* * * * *